US005769648A

United States Patent [19]

Hayashi

[11] Patent Number: 5,769,648

[45] Date of Patent: Jun. 23, 1998

[54] SIMPLE WATERPROOF CONNECTOR

[75] Inventor: Hiroyuki Hayashi, Yokkaichi, Japan

[73] Assignee: Sumitomo Wiring Systems, Ltd., Japan

[21] Appl. No.: 861,704

[22] Filed: May 22, 1997

Related U.S. Application Data

[63] Continuation of Ser. No. 375,483, Jan. 19, 1995, abandoned.

[30] Foreign Application Priority Data

Jan. 31, 1994 [JP] Japan ..... 6-029073

[51] Int. Cl.[6] ..... H01R 4/60; H01R 15/00

[52] U.S. Cl. ..... 439/206; 439/732

[58] Field of Search ..... 439/732, 206, 439/255, 260, 290, 293, 284, 271, 692, 699, 934.1

[56] References Cited

U.S. PATENT DOCUMENTS

| | | | |
|---|---|---|---|
| 4,061,406 | 12/1977 | Kunkle | 439/732 |
| 4,793,819 | 12/1988 | Berg | 439/142 |
| 5,173,062 | 12/1992 | Uchida | 439/732 |
| 5,276,307 | 1/1994 | Higgins | 439/206 |

FOREIGN PATENT DOCUMENTS

| | | |
|---|---|---|
| 36 42 143 | 4/1987 | Germany . |
| 55-89280 | 6/1980 | Japan . |
| 56-57486 | 5/1981 | Japan . |
| 2 253 951 | 9/1922 | United Kingdom . |

OTHER PUBLICATIONS

Patent Abstracts of Japan, vol. 017, No. 214 (Publication N0. JP 4351865), Apr. 27, 1993.

*Primary Examiner*—Hien Vu
*Attorney, Agent, or Firm*—Banner & Witcoff, Ltd.

[57] ABSTRACT

A water-resistant electrical connector has a flow-down space S, through which water passes, formed between the outside surface of female terminal housings 30 and the inside of a male hood 12. Water which penetrates inside the male hood 12 from the end thereof passes through a flow-down space S to exit apertures 20, 37. Neighboring terminals are separated by hollow partition walls 11, 31. Partition walls 18 may project from the male connector and pass between adjacent female terminal housings to improve electrical isolation.

7 Claims, 5 Drawing Sheets

SIMPLE WATERPROOF CONNECTOR

This is a continuation of application Ser. No. 08/375,483, filed on Jan. 19, 1995, now abandoned.

FIELD OF THE INVENTION

The present invention relates to a water-resistant electrical connector.

BACKGROUND OF THE INVENTION

In electrical connectors which are located where there is a risk of being wetted by water, water-resistant connectors are widely used. These connectors have a water resistant construction whereby moisture is prevented from entering in from the outside by sealing rings and the like provided inside on the surface where the male and female parts of the connector fit together. Such water-resistant connectors are more expensive than non-water-resistant connectors due to the provision of the sealing ring or the like. Therefore, less expensive non-water-resistant connectors are used in locations which it is considered will not normally be exposed to water, for example the many connectors used in the engine compartment of an automobile.

However, there are instances in which water makes contact with places which it is considered will not normally be exposed to water, for example condensed water may drip on to the connector, or water from a road surface thrown up by a vehicle may drip down. In conventional connectors the male connector housing is provided with a male hood which projects to the front of the male terminal, and the outer surface of the female terminal receiving slot of the female connector housing is formed to give a small clearance, to an extent such as will not impede its insertion, so that the two connector housings couple together securely. In consequence, any water reaching the male hood from the front thereof penetrates into the recesses inside the male hood in the slight clearance described above due to capillary action, and ends up reaching the electrodes. There is a risk that the water will connect a plurality of electrodes and there will be leakages of electric current. It would be uneconomic to try to prevent such current leakages by extending the use of water-resistant connectors to locations where there is a risk of occasional wetting.

SUMMARY OF THE INVENTION

Thus, the present invention aims to provide a simple water-resistant connector which can prevent electrical current from leaking between electrodes in the connector housings even when exposed water.

According to the invention there is provided a water resistant electrical connector comprising male and female components, the female component being adapted to receive a hood of the male component, and having a plurality of projecting female terminal housings, characterised in that a flow-down space is provided between the outer surfaces of said female terminal housings and the inner surface of said hood.

If water penetrates into the male hood from the front thereof when the male component and the female component are fitted together and coupled, then, because a flow-down space is provided between the inner surface of the male hood and the outer surfaces of the female terminal housings the water drains away. In other words, because the openings for inserting the male terminals are formed at the front of the female terminal housing, the water flows away downwards before it reaches these openings. Thus, a male terminal inserted in an opening is prevented from making contact with water and from thus being connected with any other adjacent electrode; it is therefore difficult for a leakage current to flow between the two electrodes.

A flow-down space is preferably formed between individual projecting female terminal housings, water penetrating the male hood draining away through this flow-down space as well.

Preferably the female component includes a connector wherein the female component includes a female partition wall between two adjacent female terminal housings at the rear thereof, said female partition wall projecting rearwardly of the female terminal housings. A female portion wall is preferably provided between all adjacent female terminal housings.

These female partition walls projecting rearwardly from the female terminal housings prevent leakage of current by extending the surface running between the electrodes.

Preferably the or each female partition wall is hollow; this improves electrical isolation of adjacent terminals.

In a preferred embodiment the male component includes a plurality of tubular male terminal housings, a male partition wall provided between two adjacent male terminal housings projecting rearwardly thereof. Preferably all partition walls of the male component project rearwardly, and preferably each such partition wall is hollow. This arrangement again prevents possible leakage of current between adjacent terminals.

According to another feature of the invention, the male component further includes a projecting partition wall extending from between two adjacent male terminal housings and adapted to pass between two adjacent female terminal housings, a flow-down space being provided between the outer surface of said projecting partition wall and the outer surface of the adjacent female terminal housings. Such a projecting partition wall may be provided between all male terminal housings.

According to this feature, even if water does penetrate the connector, two adjacent electrodes can be prevented from being electrically connected since the inner partition wall is provided in the male connector housing in a position between the female terminal housings, and another flow-down space is formed.

Water-extraction holes running through from the flow-down spaces to the outside are provided to the bottom of the male connector housing and/or the female connector housing. These holes prevent water from accumulating inside the male hood.

Other aspects of the invention will be apparent from the following description in which a preferred embodiment is described in detail with reference to the accompanying drawings in which:

DETAILED DESCRIPTION OF THE PREFERRED EMBODIMENT

Figure 1:
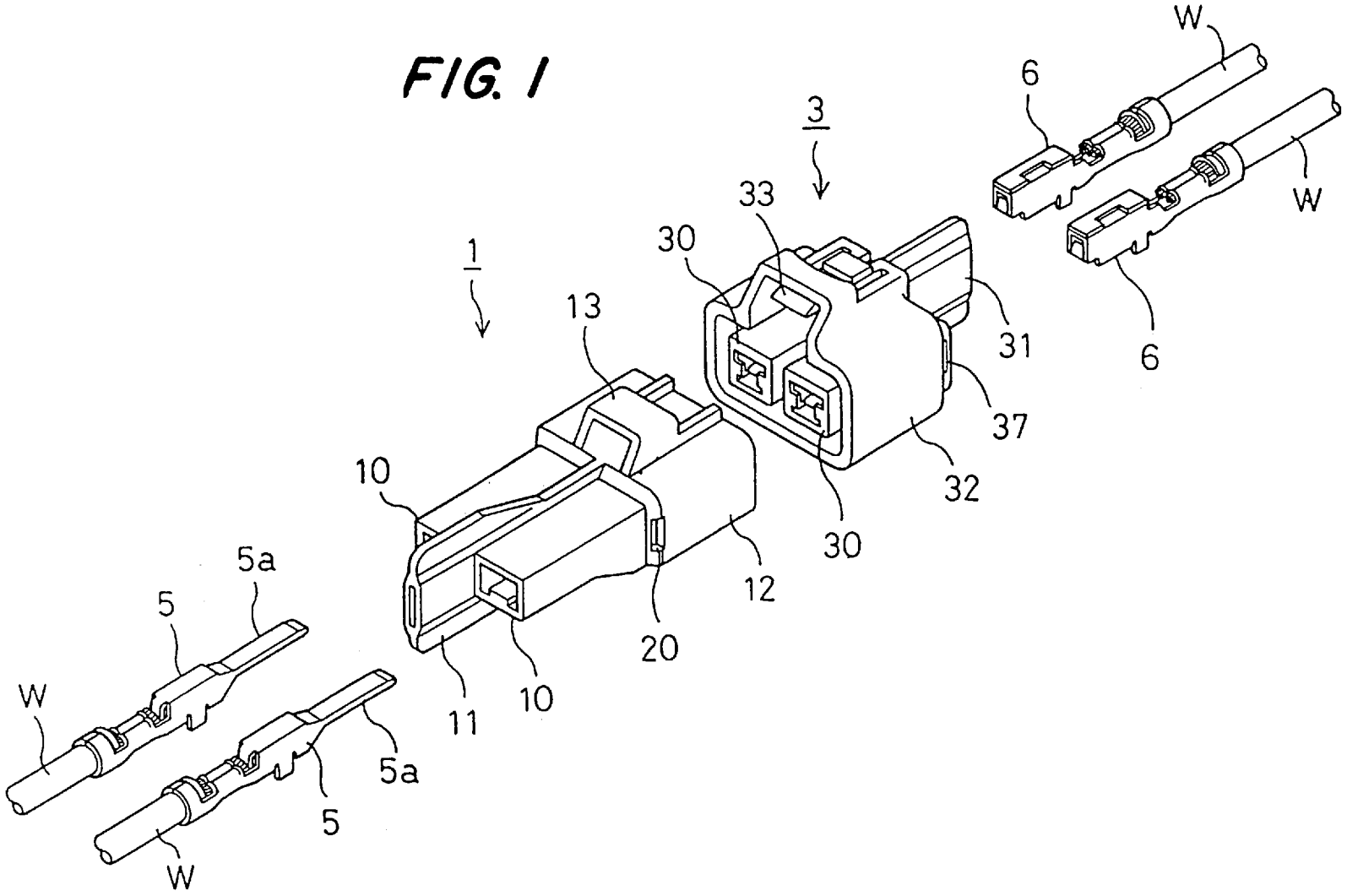
FIG. 1 is an exploded isometric view of the components of a connector according to the invention.

The connector of this embodiment is a two-electrode connector and, as shown in FIG. 1, comprises a male connector housing 1 which is integrally formed from a synthetic resin and which holds the male terminals 5, and a female connector housing 3 which is integrally formed from a synthetic resin and which holds the female terminals 6. When the two connector housings 1 and 3 are fitted together, the respective male and female terminals 5 and 6 fit together and electrical contact is made.

Tubular male terminal housings 10 of approximately rectangular cross-section, in which the two male terminals 5 are respectively inserted, are formed in parallel in the male connector housing 1. The housings 10 are separated by a rear partition wall 11. To the front of the connector a male hood 12 is provided which completely surrounds the two male terminal housings 10. Tubular female terminal housings 30 of rectangular cross-section, in which the two female terminals 6 are respectively inserted, are formed in parallel in the female connector housing 3. The female connector housing 3 is provided with a rear partition wall 31 formed projecting to the back of the housings 30, and is provided with a female hood 32 which completely surrounds the periphery of the housings 30. When the male hood 12 is fitted into the female hood 32, an engagement lock aperture 13 formed on the top surface of the male connector housing 1 engages with an engagement arm 33 formed projecting in the top surface of the female connector housing 3, thereby locking the two connector housings 1 and 3 together.

Figure 2:
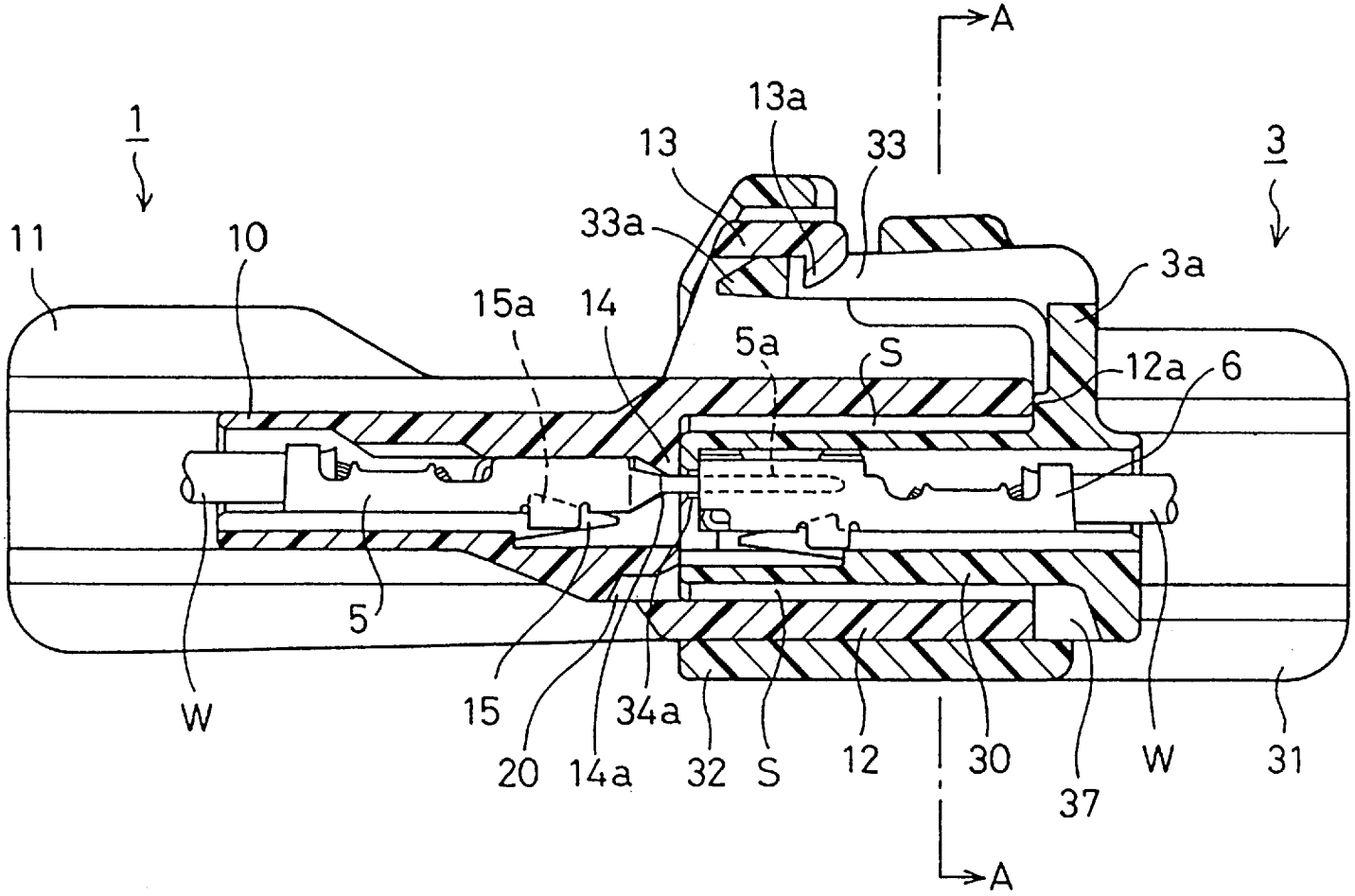
FIG. 2 is a longitudinal cross-section through the connector in the coupled state.
Figure 3:
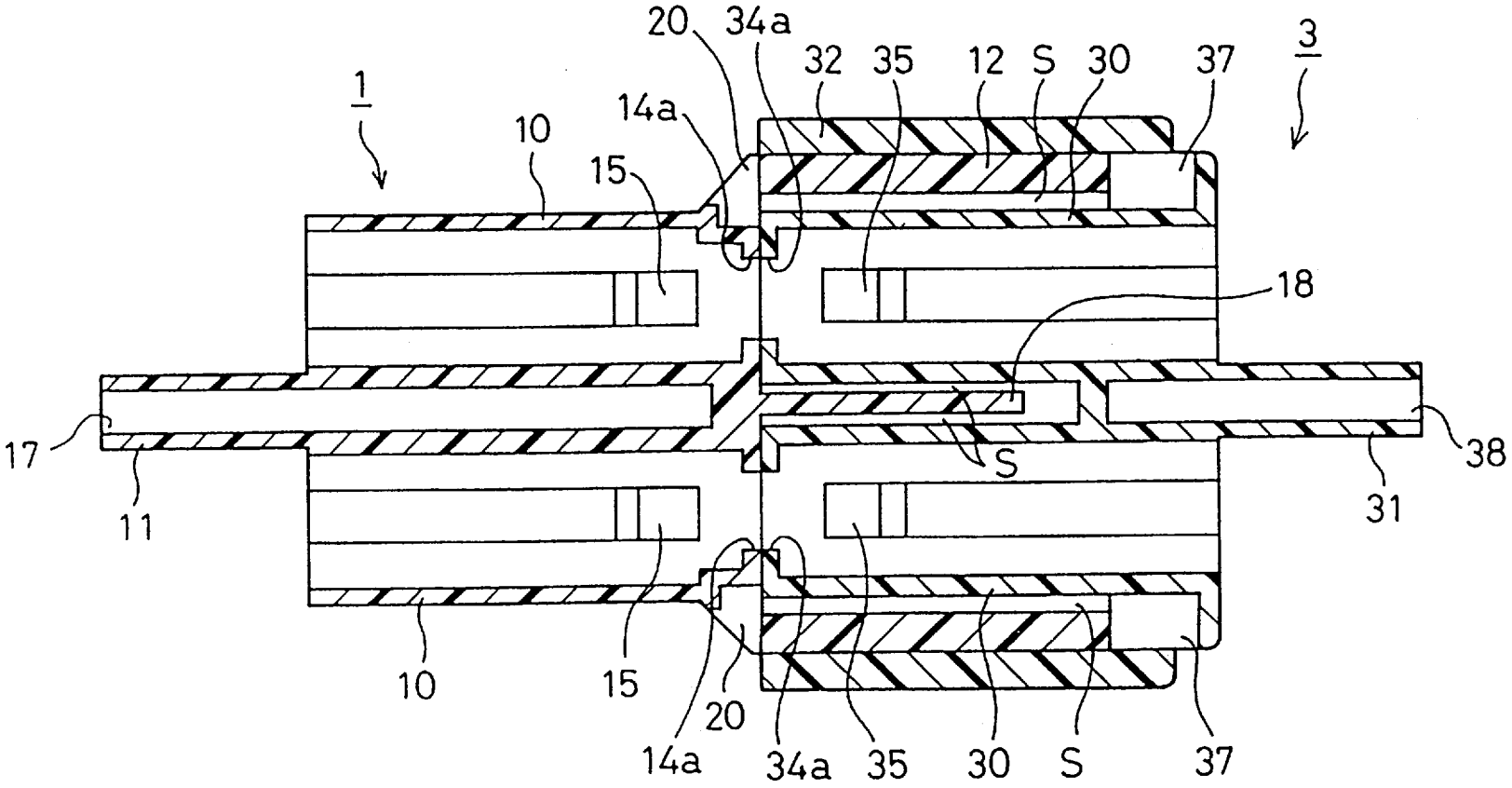
FIG. 3 is a lateral cross-section in the coupled state in which the terminals have been omitted.
Figure 4:
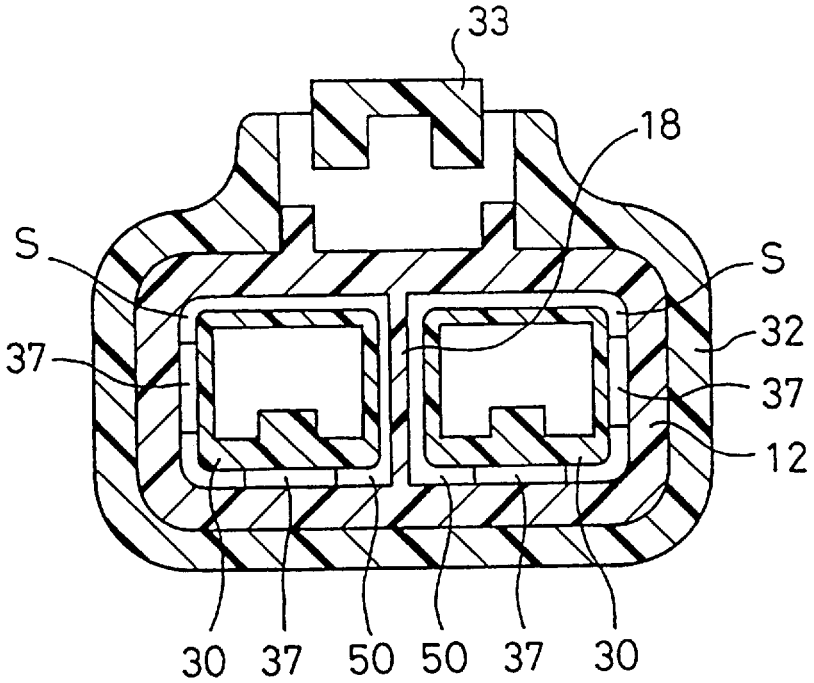
FIG. 4 is a cross-section along the line A—A in FIG. 2 and in which the terminals have been omitted.

As shown in FIG. 2 and FIG. 3, the rear of the male terminal housing 10 is open so that a male terminal 5 can be inserted from the back. The front of the housing has a male tab through-hole 14*a* in end floor wall 14 constituting the end surface of the male hood 12, and a male tab 5*a* at the front of the male terminal 5 received therein is provided in such a way that it projects from the male tab through hole 14*a* into the male hood 12. In addition, the male terminal housing 10 has a length such that it receives the end of an electrical wire W attached to the male terminal 5, as well as the male terminal 5 itself. A tongue-shaped lance 15 capable of flexing upwards and downwards extends forwards in the lower surface inside the male terminal housing 10, and an engagement projection 15*a* provided at the top of the front of the lance 15 is provided for engagement with the male terminal 5 which has been inserted into the housing 10; the male terminal 5 is thus caught inside the housing 10.

A plate-like rear partition wall 11 is provided which is constituted by vertical side walls on the insides of the two female terminal housings 10 and substantially to the rear. As shown in FIG. 1 and FIG. 3, this rear partition wall 11 is designed in such a way that it is a single vertical plate, and is provided with a spacing hole 17 opening to the back. The hollow wall 11 ensures a substantial distance between the left and right male terminal receiving slots 10, so that there is a very greatly reduced possibility of leakage current at the rear between the male terminals 5.

The male hood 12 provided at the front of the male terminal housings 10 constitutes an approximately rectangular tube completely surrounding the two projecting female terminal housings 30. It has an inner partition wall 18 formed projecting from the centre of the end wall 14, and the distance of the surface running between the male terminals 5 is substantial. Furthermore, when the two connector housings 1 and 3 are coupled together, as described hereinbelow, the inner partition wall 18 is inserted between the female terminal housings 30, thereby preventing electrical shorting across the gap between the two female terminal housings due to moisture.

Figure 5:
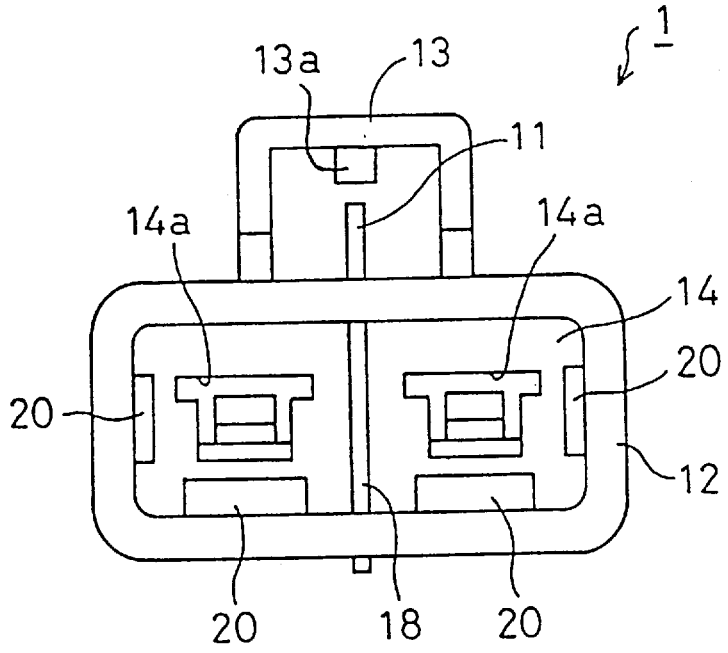
FIG. 5 is a front elevation of a male connector housing.

Four water-extraction holes 20 leading through to the outside are provided on the end edges of the male hood 12. As shown in FIG. 1 and FIG. 5, the water-extraction holes 20 are formed in both the left and right sides, and to the bottom of either side of the inner partition wall 18; they have a construction such that, even if water penetrates into the male hood 12, it flows out from the water-extraction holes 20 and does not accumulate inside the male hood 12.

A catch lock 13 with a cross-section in the shape of an upturned U projects from the top surface of the male hood 12, and a lock projection 13*a* is provided thereon and facing downwards to the front, engaging with the engagement arm 33 to engage and lock the female connector housing 3 (refer to FIG. 2).

As shown in FIG. 2, the female connector housing 3 is provided with a female hood 32 provided projecting forwards from a base plate 3*a* and fitting around the outer surface of the male hood 12 more or less hermetically, thereby allowing the female connector housing 3 to fit with the male connector housing 1 in secure fashion. Furthermore, in the top surface of the female connector housing 3 is formed a resilient engagement arm 33 provided on its front with a lock 33*a* which engages with the lock projection 13*a* of the engagement lock 13, said engagement arm 33 projecting forwards from the base 3*a*. In use the two connector housings 1 and 3 are coupled together by engaging the lock projection 13*a* and the lock 33*a*, and released by flexing the engagement arm 33 to release the engagement.

As shown in FIG. 2, the tubular female terminal housings 30 are formed projecting forwards from the base plate 3*a* leaving a space between them. A flow-down space S approximately 0.6–1.5 mm wide is formed between the outer surfaces of the female terminal housings 30 and the inner surface of the male hood 12 so that water does not experience any capillary action. Furthermore, a flow-down space S is similarly formed with respect to the inner partition wall 18 provided the two female terminal housings 30. Therefore, the construction is such that, even if water does cling to the top surface of a tubular female terminal housing 30, the water does not form a film under capillary action and thereby follow the outer wall of the female terminal housing 30 and penetrate in the front-to-rear direction; instead it flows down, running along the outer surface of a female terminal housing 30.

The rear of a female terminal housing 30 is open and arranged in such a way as to allow the female terminal 6 to be inserted, while in the front is formed a through-opening 34*a* for the male tab 5*a* to penetrate and to be inserted and form a connection inside the female terminal 6 when the two connector housings 1 and 3 are coupled together. In addition, the female terminal housing 30 has a length such that it receives the end of an attached electrical wire W, as well as the female terminal 6. A female terminal 6 can be caught on its lower surface by means of the engagement projection 35*a* of a tongue shaped lance 35 extending forwards from the lower surface similarly to the male terminal housing 10.

When the two connector housings 1 and 3 are coupled together, the end surfaces 34 and 12*a* of the male hood 12 touch the base plate 3*a* in an abutting manner, and large amounts of water are prevented from penetrating into the male hood 12 by the narrow gap between these end surfaces. However, the narrow gap cannot completely prevent water from penetrating, but the water which does penetrate has no force and does not more than quietly flow away.

Figure 6:
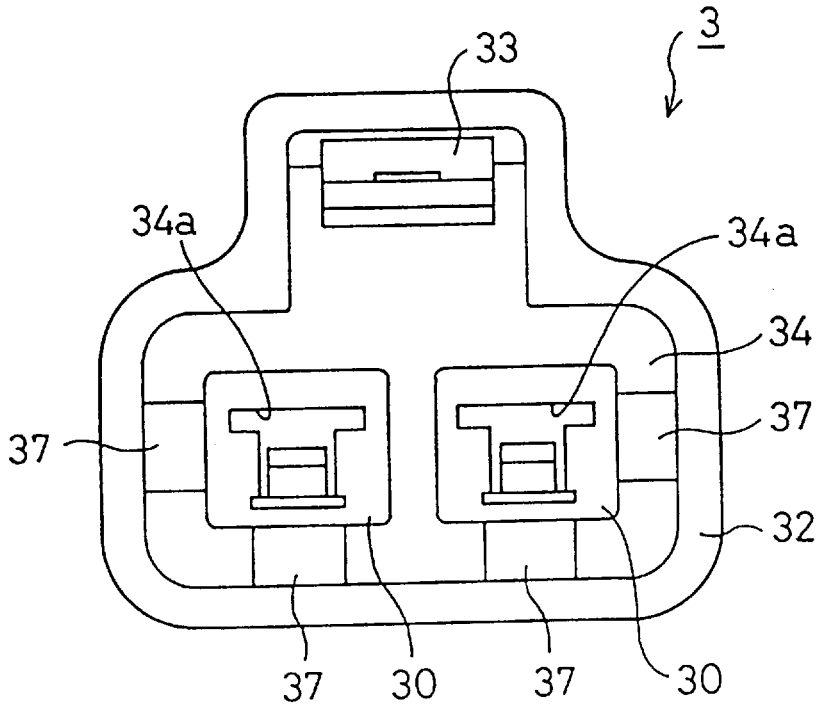
FIG. 6 is a front elevation of a female connector housing.

Four water-extraction holes 37 are provided running through to the outside in the base projecting from the base plate 3*a* of the female hood 32. As shown in FIG. 3 and FIG. 6, the water-extraction holes 37 are respectively formed in both the left and right sides and below the female terminal housings 30, and water which penetrates into the male hood 12 flows away through the flow-down space S, follows along the lower surface of the male hood 12 and flows out from the front, outside the female hood 32. In this way, any water which has flowed through the flow-down space S does not accumulate inside the male hood 12. Moreover, water which has similarly followed along the top of the lower surface of the male hood also flows out by the water-extraction holes 20 formed in the base edge of the male hood 12 described above, and thus water does not accumulate.

The female connector housing 3 has formed in it a plate-shaped rear partition wall 31 which defines vertical inner side walls of the two female terminal housings 30 substantially to the back, and similar to the male connector housing 1. This rear partition wall 31 is designed in a similar manner to the partition wall so that a spacing aperture 38 opens at the back, and has a substantial distance running between the left and right female terminal housings 30. In this way leakage current at the back between the female terminals 6 is avoided.

When the two connector housings 1 and 3 constructed in this way are coupled together and attached in their attachment portion and are wetted by water to the extent of drops of water, then the water may penetrate into the male hood 12 from the space formed between the two connector housings 1 and 3, which is to say the space formed by the front of the male hood 12 and the base plate 3*a*. The water which penetrates in this way runs along the outside surface of the female terminal housing 30 and flows down through the down-flow space S on to the base of the male hood 12. Furthermore, a flow-down space S in which capillary action does not take effect is provided between the top surfaces of the female terminal housings 30 and the male hood 12, and it is difficult for water to flow to the front along the top surface of a female terminal housing 30. Therefore, water is prevented from flowing to the end of the female terminal housing 30 and touching either the female or the male terminals 5 and 6 accommodated inside.

Furthermore, if water continues to flow into the male hood 12, the water which flows down onto the base surface of the male hood 12 flows out from the water-extraction holes 20 and 37 and does not accumulate in the male hood 12. Even when a substantial amount of water has penetrated and reaches the electrodes 5 and 6 from the ends of the female terminal housings 30, the inner partition wall 18 partitions the two female terminal housings 30, and the gap between the two terminals is therefore prevented from being directly shorted by water.

If the sides or the back of the two connector housings 1 and 3 are wetted, there is no shorting because the two terminals are separated by the rear partition walls 16 and 31. Furthermore, substantial leakage currents are prevented because the length of the partition walls is also substantial.

The two connector housings 1 and 3 are integrally formed using a synthetic resin without using separate articles such as sealing rings, and they can thus be easily manufactured.

Although this embodiment shows an example of a two-electrode connector, the invention can be applied to a connector with more than two terminals.

Furthermore, this embodiment is of an example using water-resistant types of terminals 5 and 6 with wiring attached which are inserted inside the respective terminal housings 10 and 30, but the water-resisting effect can be further improved by inserting terminal pieces with water-resistant rings attached around the wires W, as is known to the prior art.

I claim:

1. A water resistant electrical connector comprising male and female components, the male component having a male hood with an inner surface, and the female component having a female hood adapted to receive said male hood and having a plurality of projecting female terminal housings adapted to receive female terminals, said female housing having respective outer surfaces which are surrounded by an inner surface of said male hood, wherein the outer surfaces of said female terminal housings and the inner surface of said male hood are separated by a gap of sufficient size to substantially avoid the movement of water therebetween under capillary action and thereby define a flow-down space therebetween, one or more water extraction apertures being provided in one of the male and female hood in fluid communication with said flow-down space to allow water in the flow-down space to escape from the connector without entering the female terminal housings, and wherein the female component further includes a hollow female partition wall between two adjacent female terminal housings at inner ends of said two adjacent female terminal housings, said hollow female partition wall projecting rearwardly and outwardly from the female terminal housings, whereby the hollow female partition wall prevents a leakage of current at a back portion of said female component between the female terminals.

2. A connector according to claim 1 wherein said male component includes a plurality of tubular male terminal housings, a male partition wall being provided between two adjacent male terminal housings and projecting rearwardly thereof.

3. A connector according to claim 2 wherein said male partition wall is hollow.

4. A connector according to claim 2 wherein the male hood includes a projecting partition wall extending between two adjacent male terminal housings and adapted to pass between two adjacent female terminal housings, a outer surface of said projecting partition wall and the outer surface of the adjacent female terminal housings defining a portion of the flow-down space.

5. A connector according to claim 4 wherein a projecting partition wall is provided between all adjacent male terminal housings.

6. A connector according to claim 1 wherein one or more water-extraction apertures are provided in the male component in fluid connection with said flow-down space.

7. A connector according to claim 1 wherein one or more water-extraction apertures are provided in the female component in fluid connection with said flow-down space.

* * * * *